US006725890B1

(12) United States Patent
Green et al.

(10) Patent No.: US 6,725,890 B1
(45) Date of Patent: Apr. 27, 2004

(54) APPARATUS AND METHOD FOR AUTOMATICALLY HANDLING AND FILLING DRUMS

(75) Inventors: Donald H Green, Freeport, TX (US); Michael J. Seiver, Houston, TX (US)

(73) Assignee: Specialty Equipment Fabrication Company, Houston, TX (US)

( * ) Notice: Subject to any disclaimer, the term of this patent is extended or adjusted under 35 U.S.C. 154(b) by 0 days.

(21) Appl. No.: 10/408,911

(22) Filed: Apr. 9, 2003

(51) Int. Cl.[7] ..... B65B 43/42; B67C 3/00

(52) U.S. Cl. ..... 141/172; 141/168; 141/181; 141/374; 53/266.1

(58) Field of Search ..... 141/83, 129, 168, 141/171, 172, 180, 181, 374; 53/281, 367, 285, 266.1; 426/399, 392, 400, 407, 397, 131

(56) References Cited

U.S. PATENT DOCUMENTS 4,494,583 A * 1/1985 Reeves et al. ..... 141/83
4,929,459 A * 5/1990 Silvestrini ..... 426/399
5,034,067 A * 7/1991 Gewirtz et al. ..... 134/41
5,305,581 A * 4/1994 Reeves et al. ..... 53/468

* cited by examiner

*Primary Examiner*—Timothy L. Maust
(74) *Attorney, Agent, or Firm*—Bill B. Berryhill

(57) ABSTRACT

Apparatus for automatically handling and filling drums comprising a conveyor on which drums may be sequentially moved to an orienting station, a filling station and a capping and sealing station. The orienting station includes a rotating mechanism for rotating the drum so that a bunghole in the upper end thereof is properly oriented for subsequent filling. The filling station includes a tubular filling lance connected to a source of liquid and which may be lowered into the bunghole for filling the drum with liquid and then raised allowing the drum to be moved to the capping and sealing station.

21 Claims, 3 Drawing Sheets

APPARATUS AND METHOD FOR AUTOMATICALLY HANDLING AND FILLING DRUMS

BACKGROUND OF THE INVENTION

1. Field of the Invention

The present invention pertains to apparatus and methods for filling containers with liquid. More specifically, the present invention pertains to automatic handling and filling of drums with liquid utilizing a tubular filling lance through which liquid is transferred to the drum and with orienting apparatus for properly orienting the drum opening or bunghole for engagement by the tubular filling lance.

2. Description of the Prior Art

There are many designs and methods for filling drums with liquid. Some of the most successful and efficient designs utilize a tubular filling lance which is operatively connected to a source of liquid and which is vertically moveable by a power device between raised and lowered positions. The lance is positioned above an opening in the drum, commonly referred to as a bunghole, and lowered into the drum for the filling thereof. After the drum is filled, the lance is returned to a fully raised and/or withdrawn position and the bunghole is closed by a closure member commonly referred to as the bung.

In many drum handling and filling methods of the present day, a conveyor system is provided on which the drums may be sequentially moved to various positions, eventually arriving at a filling station in which a tubular filling lance is aligned with the drum bunghole and lowered through the bunghole into the drum for the filling thereof. After the drum is filled, the tubular lance is raised and the drum is moved from the filling station to a capping and sealing station.

One of the problems in providing for automatic handling and filling of drums is proper orientation of the drum as it enters the filling station. Typically, drums are placed on the conveyor system so that the openings or bungholes are randomly oriented. They must then be oriented in some fashion so as to be properly aligned with the tubular filing lance when they reach the filling station. Otherwise, the lance would not be capable of properly engaging the bungholes for filling of the drum.

A few designs have been developed for orienting drums prior to the filling thereof. One such apparatus is shown in U.S. Pat. No. 4,494,583. However, in this design the drum is not aligned until it reaches the filling station and it requires a sensing mechanism to be pivoted into position for orienting of the drum and then out of position to allow engagement by the filling lance. This slows down the operation of a system. It also utilizes orientation apparatus which includes drive wheels which engage the cylindrical surface of the drum to rotate the drum into proper alignment or orientation. Since the lower end of the drum usually rests on a conveyor, any slack or play in the conveyor itself may result in misalignment of the bunghole. This would be particularly true if the drum were aligned prior to reaching a filling station.

SUMMARY OF THE PRESENT INVENTION

The present invention provides apparatus for automatically handling and filling drums the upper ends of which are provided with bungholes for filling of the drums with liquid. An elongated conveyor is provided on which the drums may be sequentially moved to an orienting station, a filling station and a capping and sealing station.

The orienting station includes a lifting device, a rotating device and a sensing device. The lifting device lifts the drum off of the conveyor and the rotating device rotates the drum about a vertical axis until the sensing device indicates that the drum bunghole is properly positioned for further movement to the filling station.

With the bunghole properly oriented, a tubular filling lance, which is operatively connected to a source of liquid, is moved by a power device from a raised position above the drum to a lowered position in which the filling lance is coaxially aligned with and extends through the bunghole into the drum for filling the drum with liquid. After a weighing device indicates that the drum is filled, the filling lance is returned to a raised position by the power device and the filled drum is moved to the capping and sealing station where the bunghole may be capped and sealed.

Thus, the present invention provides apparatus and method of operation thereof for automatic handling and filling of drums by sequential movement along a conveyor to an orienting station, a filling station and a capping and sealing station. The drum bunghole is properly oriented before reaching the filling station where a tubular filling lance is automatically lowered through the bunghole filling the drum to the desired weight and transferring the filled drum to a capping and sealing station where the bunghole may be capped and sealed and the filled drum shipped or stored wherever desired. The entire operation may be performed with minimum manual labor and is done so in a sequential operation with little delay. Many other objects and advantages of the invention will be apparent from reading the description which follows with the accompanying drawings.

DESCRIPTION OF A PREFERRED EMBODIMENTS

Figure 1:
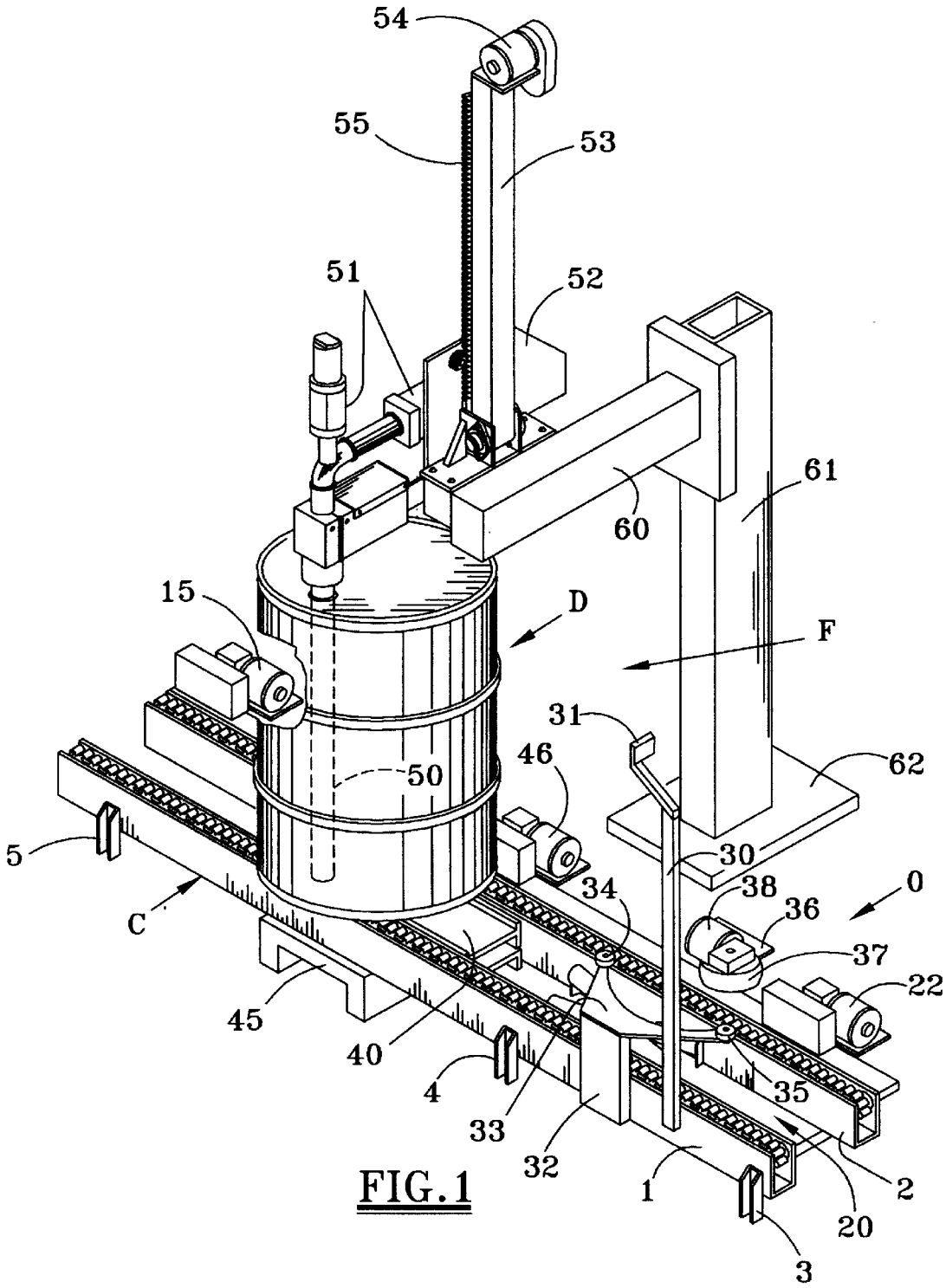
FIG. 1 is a perspective view of the automatic drum handling and filling apparatus of the present invention, according to a preferred embodiment thereof.

Referring first to FIG. 1, there is shown apparatus of the present invention which is designed for automatically handling and filling drums such as drum D the upper ends of which are provided with openings or "bungholes" for the filling thereof. The bungholes may be closed by closure members or "bungs". These drums may be typically stored or accumulated at some location (not shown) and are eventually moved by a conveyor system a portion of which is generally indicated at C in FIG. 1 and by which the drums may be sequentially moved to an orienting station O, a filling station F and a capping and sealing station (not shown).

Figure 2:
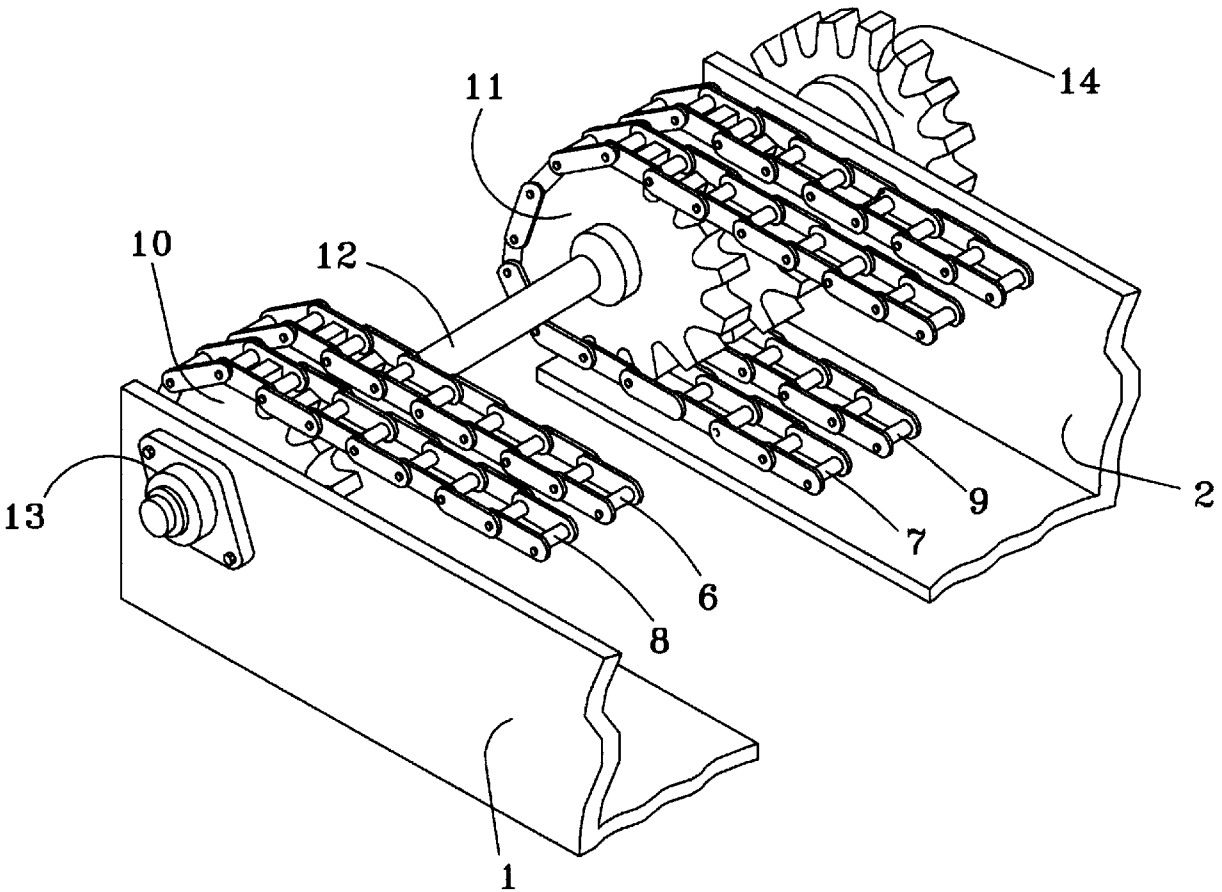
FIG. 2 is a perspective view of a portion of the conveyor apparatus of the present invention, according to a preferred embodiment thereof.
Figure 3:
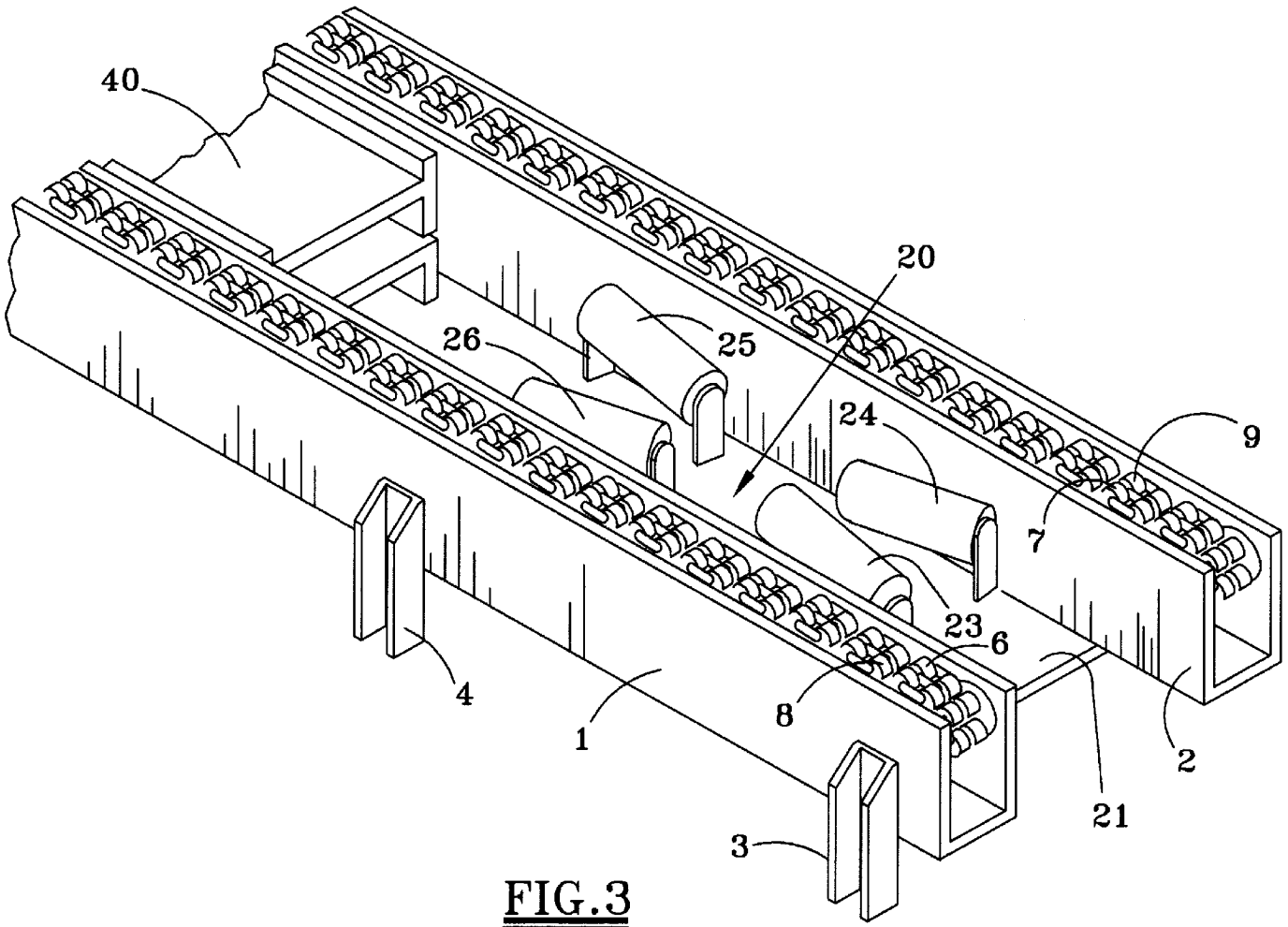
FIG. 3 is a perspective view of a portion of the conveyor apparatus as well as portions of apparatus at the orienting station and the filling station, according to a preferred embodiment thereof.

The portion of the conveyor system illustrated in FIG. 1 may comprise a pair of spaced apart upwardly opening elongated channel members 1 and 2 (see also FIG. 3) horizontally supported on a plurality of support legs 3, 4, 5 etc. Disposed within the channel members 1 and 2, as best seen in FIG. 3, are two pairs of parallel chains a first pair 6 and 7 spaced apart to engage lower ends of drum D on opposite sides of the vertical center thereof and a second pair 8 and 9 spaced apart to engage the lower end of drum D on opposite sides of the vertical center thereof but further from the center than the first pair 6 and 7. Each of the chains 6, 7, 8 and 9 engage corresponding sprockets such as the sprockets 10 and 11 shown in FIG. 2 at opposite ends of the channel members 1 and 2. The sprockets are mounted on corresponding shafts such as 12 shown in FIG. 2 the ends of which are supported by bearing 13 and one end of which is provided with a drive sprocket 14 which may be engaged by another chain (not shown) which engages a drive motor 15 (see FIG. 1) for rotation of the sprockets 10, 11 and the shaft 12 driving the two pairs of chains 6, 7 and 8, 9 to move any drums, such as the drum D resting thereon, from a storage or accumulation area (not shown) to an orienting station O, a filling station F and eventually a capping and sealing station (not shown).

As a drum, such as drum D, moves from storage or accumulation onto the portion of the conveyor shown in FIG. 1, it first moves to an orienting station O for proper orientation of the bunghole thereof. The orienting station includes lifting apparatus 20 which is operable to lift a drum off of the conveyor chains 6, 7 and 8, 9. As partially seen in FIG. 3, the lifting apparatus may comprise a plate or inverted channel member 21 below which is provided a lift (not shown) and by which the plate member 21 may be raised and lowered between the channel members 1 and 2. A pneumatic or hydraulic motor and pump 22 may provide the necessary power therefor. Mounted on the lifting plate are a plurality of rollers 23, 24, 25 and 26 mounted on axes which are substantially horizontal and each axis of which is radially disposed relative to the vertical axis of a drum which may rest thereabove. In the lowered position, the rollers 23–26 rest below the chines at the lower end of any drum on the conveyor chains 6, 7 and 8, 9. However, when the lifting apparatus 20 is activated, raising the plate 21, the rollers 23–26 engage the drum chines to lift the drum off of the conveyor.

It will be noted in FIG. 1, that extending upwardly from one of the channel members 1 is a vertical support member 30 at the upper end of which is provided an electronic bung sensing device 31. Also extending upwardly from one of the channel members is a support arm 32 and support plate 33 at opposite ends of which are provided idler wheels 34 and 35 which would be engageable with outer surfaces of a drum located at the orienting station. Extending inwardly from a vertical support (not shown) attached to the channel member 2 is a plate 36 on which is supported, for rotation about a vertical axis, a drive wheel 37 and a power device 38 for rotation thereof. The support arm 32 and the support on which plate 36 is supported are both moveable from widely spaced apart positions which allow free movement of a drum along the conveyor C to more inwardly spaced positions in which the idler wheels 34 and 35 engage outer surfaces of a drum at the orienting station and the drive wheel 37 engages opposing outer surfaces of a drum placed at the orienting station.

By actuating the lifting assembly 20, a drum at the orienting station O may be lifted, resting only on the rollers 23, 34, 25 and 26. With the idler wheels 34 and 35 and the drive wheel 37 in the innermost positions, engaging the cylindrical surfaces of a drum located thereat, the power device 38 and drive wheel 37 may be actuated to rotate a drum at the orienting station to a pre-selected position indicated by electronic sensing of the bunghole at the upper end thereof by the electronic bunghole sensor 31. As soon as the bunghole is sensed at the proper location, rotation of the drive wheel 37 is terminated, the idler wheels 34, 35 and the drive wheel 37 are moved to outer positions disengaging the drum D. Then the lifting apparatus 20 is lowered so that the lower end of the drum at the orienting station again engages the conveyor chains 6, 7 and 8, 9 allowing the drum, with the bunghole thereof properly oriented, to move to the filling station F directly above a second lifting apparatus which includes an elongated channel or plate 40. The upper surfaces of the plate 40 normally lie below the upper moving surfaces of the chains 6, 7 and 8, 9. However, the lifting plate 40 is surmounted on hydraulic lift mechanism (not shown) powered by a pneumatic or hydraulic power device 46 by which the plate 40 may be raised to engage the lower end of drum D lifting it off of the conveyor chains 6, 7 and 8, 9. The lifting apparatus 40 is operatively associated with a weighing device 45 which may include a load cell and by which tare weight of the drum D and weight of any liquid contents (after filling thereof) may be determined when the drum D is lifted off of the conveyor by the lifting apparatus.

At the filling station F is provided a vertically disposed tubular filling lance 50 which is operatively connected through a hose or the like to a source of liquid (not shown). The lance 50 and valve assembly 51, by which flow between the supply hose and the lance 50 is controlled, are attached to a lance carriage 52 which is mounted on a vertical mast 53 for vertical up and down movement thereon. The vertical mast 53 is attached to and supported on the arm 60 of a support stanchion 61 affixed to a base 62. A power device 54 is attached to the mast and is operatively connected by a chain drive 55 to the lance carriage 52 for the up and down movement thereof. Since the lance 50 is supported by the lance carriage, the power device 54 is therefore effective in moving the lance 50 between raised positions above the drum D and lowered positions, when coaxially aligned with the bunghole in the upper end thereof (as shown in FIG. 1), to extend through the bunghole into the drum D for filling it with liquid. There are a number of designs for the construction of such vertically movably filling lances. More details of such construction and the operation thereof in a particularly well accepted design may be seen in U.S. Pat. No. 6,053,219.

Thus, the drum D may be moved from the orienting station, with its bunghole properly aligned, to the filling station F where it may be lifted and weighed and where the lance 50 may be lowered into the bunghole. As the drum D is filled with liquid, its weight is monitored and when it is completely filled, flow is terminated and the lance 50 is raised. Then the filled drum D would again be lowered onto the chains 6, 7, 8, 9 of the conveyor C for movement to a capping and sealing station where a bung may be placed in the bunghole and sealed.

The apparatus and method of the present invention provides for automatic movement of drums, from a source of empty drums, along a conveyor to an orienting station where the drum is lifted and rotated to a preselected position by electronically sensing the location of its bunghole. The drum is then lowered and moved to a filling station where the drum is lifted, tare weight measured and a filling lance is lowered into the drum for filling thereof. The contents are weighed and filling is automatically terminated when the proper weight is reached. The lance is then raised, the filling drum is lowered onto the conveyor and moved to the capping and sealing station. After capping and sealing the filled drum is conveyed to a place for transport and/or storage. All of this operation is automatic and in timed sequence so that little time is wasted as in other methods.

A single preferred embodiment of the invention has been described herein. Many variations of the apparatus and method described herein may be made by those skilled in the art without departing from the spirit of the invention. Accordingly, it is intended that the scope of the invention be limited only by the claims which follow.

We claim:

1. Apparatus for automatically handling and filling drums the upper ends of which are provided with bungholes for filling said drums with liquid, said apparatus comprising:

an elongated conveyor on which said drums may be sequentially moved to an orienting station, a filling station and a capping and sealing station;

orienting means located at said orienting station including lifting means operable to lift a drum off of said conveyor, rotating means operable to rotate said drum about a vertical axis and recognition means for sensing when the bunghole of said drum is rotated to a preselected position orienting said drum for subsequent filling, said lifting means being further operable to lower said drum onto said conveyor after said orienting thereof for further movement to said filling station; and a vertically disposed elongated tubular filling lance operatively connected to a source of liquid and to a power device by which said lance may be moved between raised positions above said drum and a lowered position coaxially aligned with and extending through said bunghole into said drum for filling said drum with liquid, said lance being moveable to said raised position by said power device when said drum is filled for further movement of said drum to said capping and filling station where said bunghole may be capped and sealed.

2. Apparatus for automatically handling and filling drums as set forth in claim 1 including weighing means located at said filling station and on which said drums may be supported for indicating when said drum is filled with liquid.

3. Apparatus for automatically handling and filling drums as set forth in claim 1 including second lifting means located at said filling station and by which said drum may be lifted off of said conveyor while it is being filled with liquid through said lance.

4. Apparatus for automatically handling and filling drums as set forth in claim 3 including weighing means located at said filling station and operatively associated with said second lifting means to weigh said drum and the liquid contents thereof when said drum is lifted off of said conveyor.

5. Apparatus for automatically handling and filling drums as set forth in claim 1 in which said rotating means comprises a pair of spaced apart idler wheels engageable with outer surfaces of said drum and a power operated drive wheel engageable with opposing surface outer surfaces of said drum for rotating said drum about said vertical axis.

6. Apparatus for automatically handling and filing drums as set forth in claim 5 in which said rotating means also includes rollers surmounted on said lifting means and engageable with a lower end of said drum when said drum is lifted off of said conveyor to rotatingly support said drum as it is rotated by said drive wheel.

7. Apparatus for automatically handling and filling drums as set forth in claim 6 in which said rollers comprise a plurality of cylindrical rollers the axes of which are substantially horizontal and each axis of which is radially disposed relative to said vertical axis of said drum.

8. Apparatus for automatically handling and filling drums as set forth in claim 1 in which said conveyor comprises at least one pair of sprocket driven parallel chains spaced apart for engagement by lower ends of said drums on opposite sides of and at substantially equal distance from the vertical centers of said drums, said lifting means being moveable between said chains for lifting said drum off of said conveyor and said chains thereof.

9. Apparatus for automatically handling and filling drums as set forth in claim 8 in which there are two pairs of said sprocket driven parallel chains, one pair being spaced further apart than the other.

10. Apparatus for automatically handling and filling drums as set forth in claim 8 including second lifting means located at said filling station and engageable with said drum between said pair of chains for lifting said drum off of said conveyor at said filling station.

11. Apparatus for automatically handling and filling drums as set forth in claim 10 including weighing means located at said filling station and operatively associated with said second lifting means to weigh said drum and the liquid contents thereof when said drum is lifted off of said conveyor by said second lifting means.

12. Apparatus for automatically handling and filling drums the upper ends of which are provided with bungholes for filling said drums with liquid, said apparatus comprising:

an elongated vertically disposed tubular filling lance operatively connected to a source of liquid and to a power device by which said lance may be vertically moved between raised and lowered position;

an elongated conveyor on which said drums may be sequentially moved to an orienting station, a filling station and a capping and sealing station;

orienting means located at said orienting station including first lifting means operable to lift a drum off of said conveyor, rotating means operative to rotate said drum about a vertical axis and recognition means for sensing when the bunghole of said drum is rotated to a preselected position orienting said drum for subsequent filling thereof, said first lifting means being operable to lower said drum onto said conveyor after said drum has been oriented for further movement to said filling station;

Second lifting means located at said filling station operable to lift said drum off of said conveyor when said bunghole is coaxially aligned with said tubular filling lance and allowing said lance to be moved to said lowered positions, within said drum, as said drum is being filled with liquid therethrough, said second lifting means being operable to lower said drum, when filled, onto said conveyor for further movement to said capping and sealing station where said bunghole may be capped and sealed.

13. Apparatus for automatically handling and filling drums as set forth in claim 12 including weighing means located at said filling station and operatively associated with said second lifting means to weigh said drum and the liquid contents thereof.

14. Apparatus for automatically handling and filling drums as set forth in claim 13 in which said weighing means comprises a load cell adjacent to said second lifting means.

15. Apparatus for automatically handling and filling drums as set forth in claim 12 including control means operatively connected to said filling lance power device, said conveyor means, said orienting means and said first and second lifting means for controlling sequential movement of a drum on said conveyor assembly for orientation at said orienting station, filling with liquid at said filling station and eventual capping and sealing at said capping and sealing station.

16. Apparatus for automatically handling and filling drums as set forth in claim 12 in which said rotating means comprises a pair of spaced apart idler wheels engageable with cylindrical surfaces of said drum and a power operated drive wheel engageable with opposing cylindrical surfaces of said drum for rotating said drum about said vertical axis.

17. Apparatus for automatically handling and filling drums as set forth in claim 16 in which said rotating means also includes a plurality of rollers surmounted on said first lifting means and engageable with the periphery of the lower end of said drum when said drum is lifted off of said conveyor to rotatingly support said drum as it is rotated by said power operated drive wheel.

18. Apparatus for automatically handling and filling drums as set forth in claim 17 in which said plurality of rollers comprises at least a first pair of rollers and a second pair of rollers spaced apart by a distance substantially corresponding with the diameter of said drum, each of said rollers being mounted for rotation on axes substantially corresponding with a radius of said drum.

19. Apparatus for automatically handling and filling drums as set forth in claim 12 in which said conveyor comprises a pair of parallel chains spaced apart to engage lower ends of said drums on opposite sides of the vertical centers thereof, said first and second lifting means being moveable between said pair of parallel chains when lifting said drum off of said conveyor.

20. Apparatus for automatically handling and filling drums as set forth in claim 12 in which said conveyor comprises two pairs of parallel chains, a first pair spaced apart to engage lower ends of said drums on opposite sides of the vertical centers thereof and a second pair spaced apart to engage lower ends of said drums on opposite sides of said vertical centers thereof but further from said centers than said first pair.

21. Apparatus for automatically handling and filling drums as set forth in claim 20 in which said first and second lifting means are moveable between both of said pairs of parallel chains when lifting said drum off of said conveyor.

* * * * *